US005959647A

United States Patent [19]

Claramunt et al.

[11] Patent Number: 5,959,647

[45] Date of Patent: Sep. 28, 1999

[54] TECHNIQUE FOR CONVERTING SINGLE CARTRIDGE MONOCHROME PRINTER TO MULTI-CARTRIDGE COLOR INKJET PRINTER

[75] Inventors: David Claramunt; Antonio Hinojosa; Ventura Caamano; Sergi Casas, all of Barcelona, Spain

[73] Assignee: Hewlett-Packard Company, Palo Alto, Calif.

[21] Appl. No.: 08/639,607

[22] Filed: Apr. 29, 1996

[51] Int. Cl.[6] ..... B41J 2/175

[52] U.S. Cl. ..... 347/49; 347/5; 347/86

[58] Field of Search ..... 347/49, 24, 43, 347/5, 86; 74/483 PB; 200/43.04, 43.22, 50.01, 50.02, 50.1, 50.32, 50.36, 5 B, 5 E

[56] References Cited

U.S. PATENT DOCUMENTS

| | | | |
|---|---|---|---|
| 4,803,500 | 2/1989 | Milbrandt | 347/49 |
| 5,077,452 | 12/1991 | Mathers et al. | 200/43.22 |
| 5,138,344 | 8/1992 | Ujita | 347/86 |
| 5,208,610 | 5/1993 | Su et al. | 347/43 |
| 5,260,892 | 11/1993 | Testa | 365/63 |
| 5,488,208 | 1/1996 | Seewald | 200/43.22 |
| 5,519,422 | 5/1996 | Thoman et al. | 347/40 |
| 5,579,477 | 11/1996 | Ogletree | 395/183.2 |
| 5,612,520 | 3/1997 | Toedtman et al. | 200/50.1 |
| 5,614,929 | 3/1997 | Dangelo et al. | 347/24 |
| 5,742,306 | 4/1998 | Gompertz et al. | 347/43 |

FOREIGN PATENT DOCUMENTS

| | | | |
|---|---|---|---|
| 421 806 | 4/1991 | European Pat. Off. | 347/19 |
| 605 183 A2 | 7/1994 | European Pat. Off. | 347/86 |
| 674 997 | 10/1995 | European Pat. Off. . | |
| 59-78858 | 5/1984 | Japan | 347/24 |
| 1-80572 | 3/1989 | Japan | 347/5 |

*Primary Examiner*—N. Le
*Assistant Examiner*—Anh T. N. Vo
*Attorney, Agent, or Firm*—David S. Romney

[57] ABSTRACT

A simplified technique and conversion kit allows a user to change a single cartridge monochrome printer into a multiple cartridge color printer without having to use the same slots in the carriage for different print cartridges. As part of the conversion, modifications are made to the carriage by manually removing a carriage cover, manually removing a service station cover for certain user-activated functions such as primer selectors, and adding a new ROM SIMM to the printer.

18 Claims, 17 Drawing Sheets

TECHNIQUE FOR CONVERTING SINGLE CARTRIDGE MONOCHROME PRINTER TO MULTI-CARTRIDGE COLOR INKJET PRINTER

BACKGROUND OF THE INVENTION

This case relates generally to inkjet printers using print cartridges, and more particularly to inkjet printers having a carriage for holding a plurality of print cartridges having different color inks.

The conventional approach for developing a family of monochrome inkjet printers/plotters is to have a monochrome version based on a first carriage and monochrome service station for respectively holding and servicing a monochrome print cartridge such as for black ink, and a color version based on a different carriage and related color service station for respectively holding and servicing a set of color print cartridges such as for cyan, yellow, magenta and black inks (typically abbreviated as C Y M K). For example, the Hewlett-Packard DESIGNJET 600 monochrome plotter provided two black ink print cartridges in a two-slot carriage, while the Hewlett-Packard DESIGNJET 650C color plotter provided four different color print cartridges in a four-slot carriage.

There have been prior products which used the same carriage design for both monochrome print cartridges as well as color print cartridges. For example, the Encad NOVAJET plotters used the same four-slot carriage for holding either four black ink cartridges, or alternatively four different color cartridges. In another example, the Hewlett-Packard DESKJET 500C used the same single-slot carriage for holding either one black ink cartridge, or alternatively one tri-compartment ink cartridge holding cyan, magenta and yellow ink. But both of these prior designs created problems associated with using the same carriage slots for different color ink cartridges as well as additional problems with the service stations having to accomodate both the monochrome as well as the color print cartridges. Accordingly, there is a need for designing a single cartridge monochrome printer which can be easily converted with an upgrade kit into a multiple cartridge color printer, without the complications and problems associated with the prior monochrome/color conversion techniques.

BRIEF SUMMARY OF THE INVENTION

It is a primary object of the invention to provide a simplified way to change a single cartridge monochrome printer into a multiple cartridge color printer without having to use the same slots in the carriage for different print cartridges. A related object is to provide an inkjet color conversion kit and technique which allows the user to modify the carriage, the service station and the software configuration of an inkjet printer as part of the overall conversion to a multiple cartridge color printer.

Thus, the invention is incorporated into an inkjet printer having a carriage which traverses between a print zone and a service station, having a plurality of slots on the carriage for holding a predetermined number of print cartridges. A plurality of actuation members is provided in the service station for servicing each of said predetermined number of print cartridges while the print cartridges remain in the carriage. A removable barrier on the carriage prevents installation of print cartridges in at least one of said slots on the carriage.

Additionally, a control member is provided on the service station for preventing operation of certain actuation members which are associated with print cartridges which are not installed in certain of said plurality of slots on the carriage. The control member includes a stop member for preventing operation of an actuation member such as a primer device associated with print cartridges which are not installed in certain of said plurality of slots on the carriage. The control member also includes activation control means on the service station for assuring the operation of certain servicing functions such as the priming of print cartridges which are installed in said slots on the carriage.

In addition to the foregoing, an upgrade kit for converting a monochrome inkjet printer into a multiple cartridge color inkjet printer includes a ROM device manually insertable in a memory module slot in the monochrome inkjet printer for changing the internal operational function of the printer to actuate at least one monochrome cartridge which is installed in a carriage slot which originally held the monochrome cartridge, as well as to actuate at least one other cartridge newly installed in a carriage slot which did not originally hold the monochrome cartridge, wherein the at least one other cartridge has different color ink than the monochrome cartridge. In the preferred form, the upgrade kit includes three new color print cartridges with cyan, magenta and yellow ink for installation in the previously unused carriage slots in the monochrome printer.

DETAILED DESCRIPTION OF PREFERRED EMBODIMENT

Figure 1:
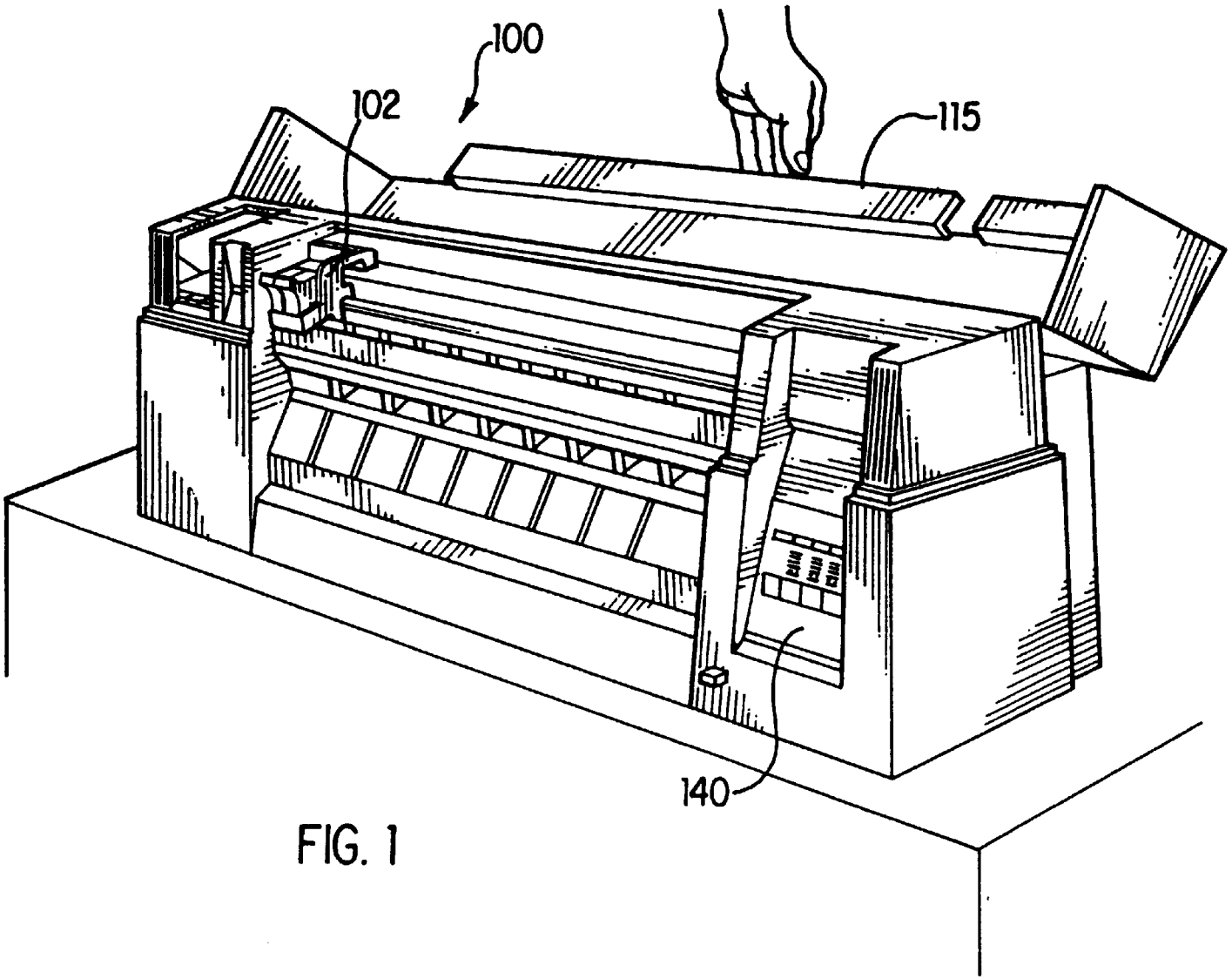
FIG. 1 is a perspective view of the front of an inkjet printer/plotter which incorporates the features of the present invention.

Generally speaking, the invention is incorporated into an inkjet printer 100 having a carriage 102 which traverses between a print zone and a service station. A plurality of slots is provided on the carriage for holding a predetermined number of print cartridges. In addition, a plurality of actuation members are typically provided in the service station for servicing each of the predetermined number of print cartridges while the print cartridges remain in the carriage. A removable barrier is added to the carriage for preventing installation of print cartridges in the non-monochrome slots.

In the preferred form of the invention, the removable barrier can be manually installed on the carriage or manually removed from the carriage while the carriage remains in position on the inkjet printer. In that regard, the removable barrier is a unitary cover member 104 which has a pair of arms 106 which are compressible into an unlatched position allowing the unitary cover member to be inserted onto the carriage, and which return to a default latched position directly engaging the carriage. When the unitary cover member is in its default latched position on the carriage, it completely covers the three non-monochrome slots thereby preventing the improper installation of a monochrome black print cartridge into one of the other carriage slots.

In the preferred form of the invention, a control member 108 is installable on the service station for preventing operation of certain actuation members which are associated with print cartridges mountable in the non-monochrome slots. The control member has many of the same beneficial characteristics as the cover member on the carriage. In that regard, the control member is a unitary device which has a pair of tabs, one of which is a fixed tab 110 and the other a flexible tab 112 which is movable into an unlatched position allowing the control member to be inserted onto the service station, after which the flexible tab springs back to return to a default latched position directly engaging the service station. When the control member is in its default latched position on the service station, it completely covers four primer activation buttons 27, 28, 29, 30 holding one of the buttons in operating position and preventing the other three buttons from being activated, all as described in more detail hereinafter.

The upgrade kit for doing the conversion of a monochrome inkjet printer into a multiple cartridge color inkjet printer includes a code storage device which can be manually inserted in a memory module slot in the monochrome inkjet printer in order to change the internal operational function of the printer. After installation of the new code storage device such as a ROM SIMM module 114, the printer is designed to operate thereafter as a full color printer capable of rendering a printout using four color ink cartridges 120, 122, 124, 126 with black, magenta, cyan and yellow inks, respectively, as described in more detail hereinafter.

Figure 2:
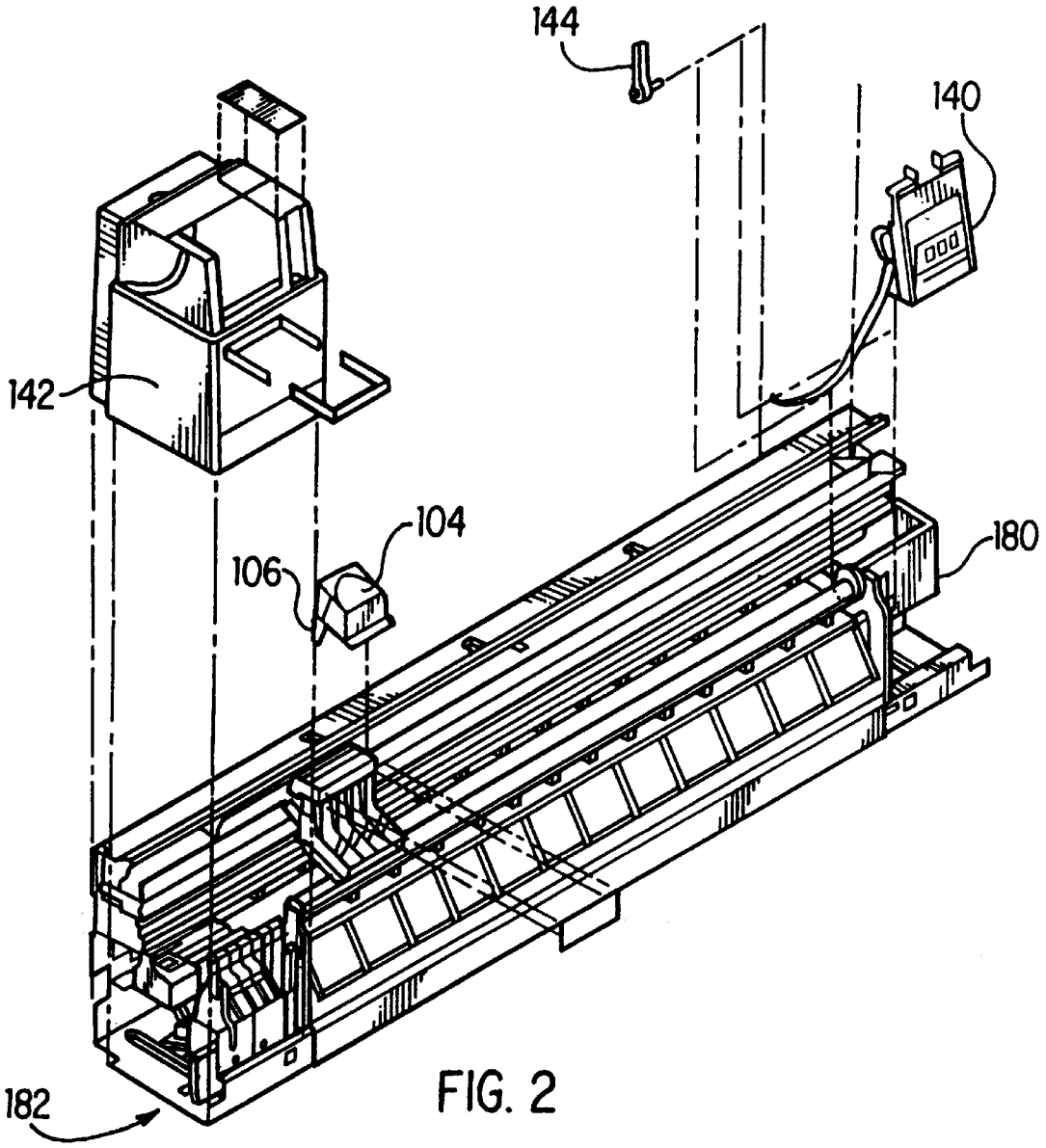
FIG. 2 is a partially exploded view of the printer/plotter of FIG. 1 generally showing a control/display panel, an empty carriage, a carriage cover, and service stations.
Figure 3:
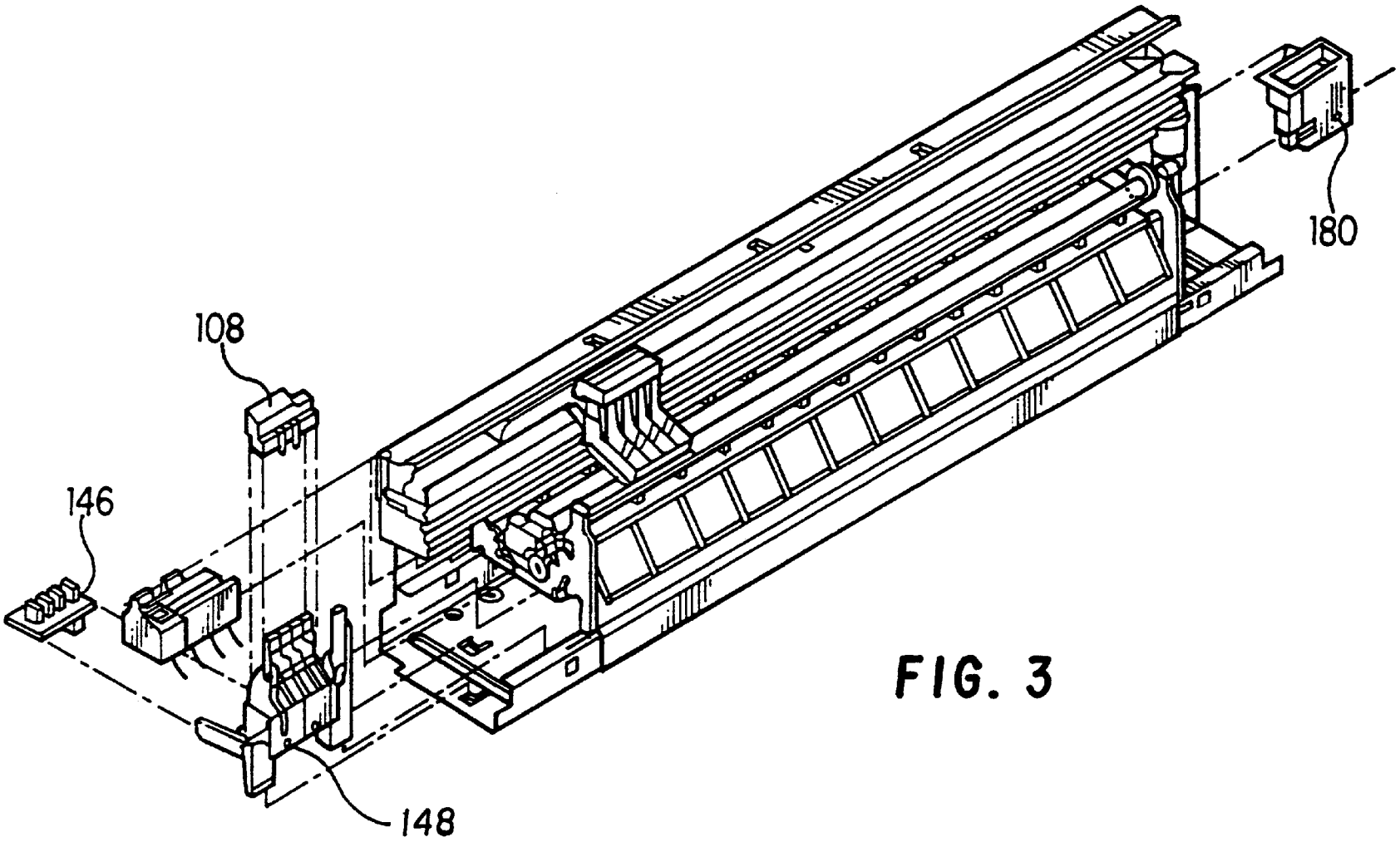
FIG. 3 is a partially exploded view of the printer/plotter of FIG. 1 showing in more detail a spittoon service station, a wiper/primer service station, and a service station cover.
Figure 4A:
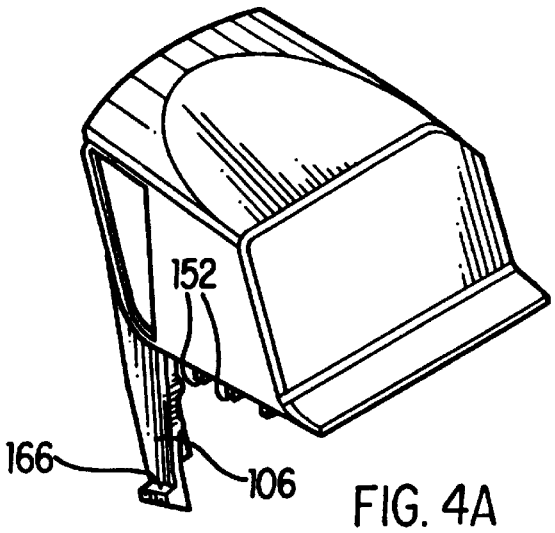
FIGS. 4A, 4B and 4C show a top front perspective view, a bottom rear perspective view, and a rear view of a carriage cover, respectively.
Figure 4B:
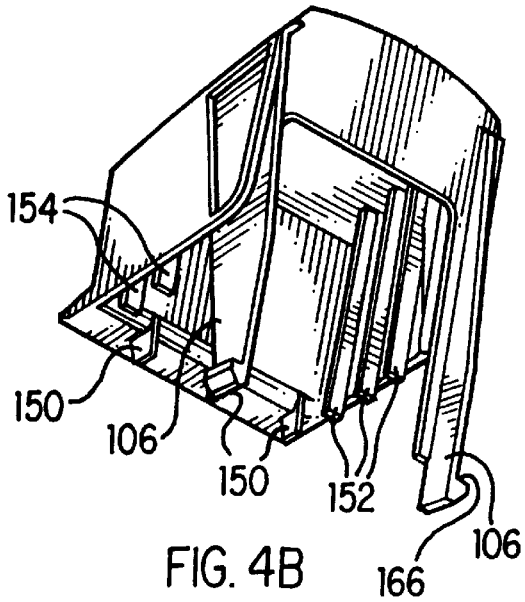
Figure 4C:
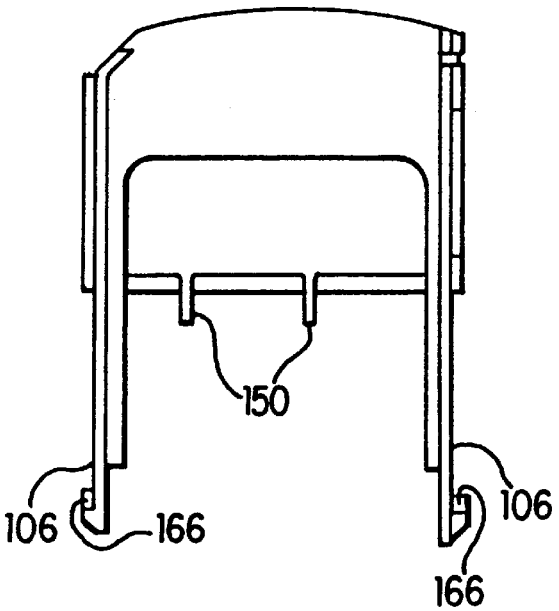
Figure 5:
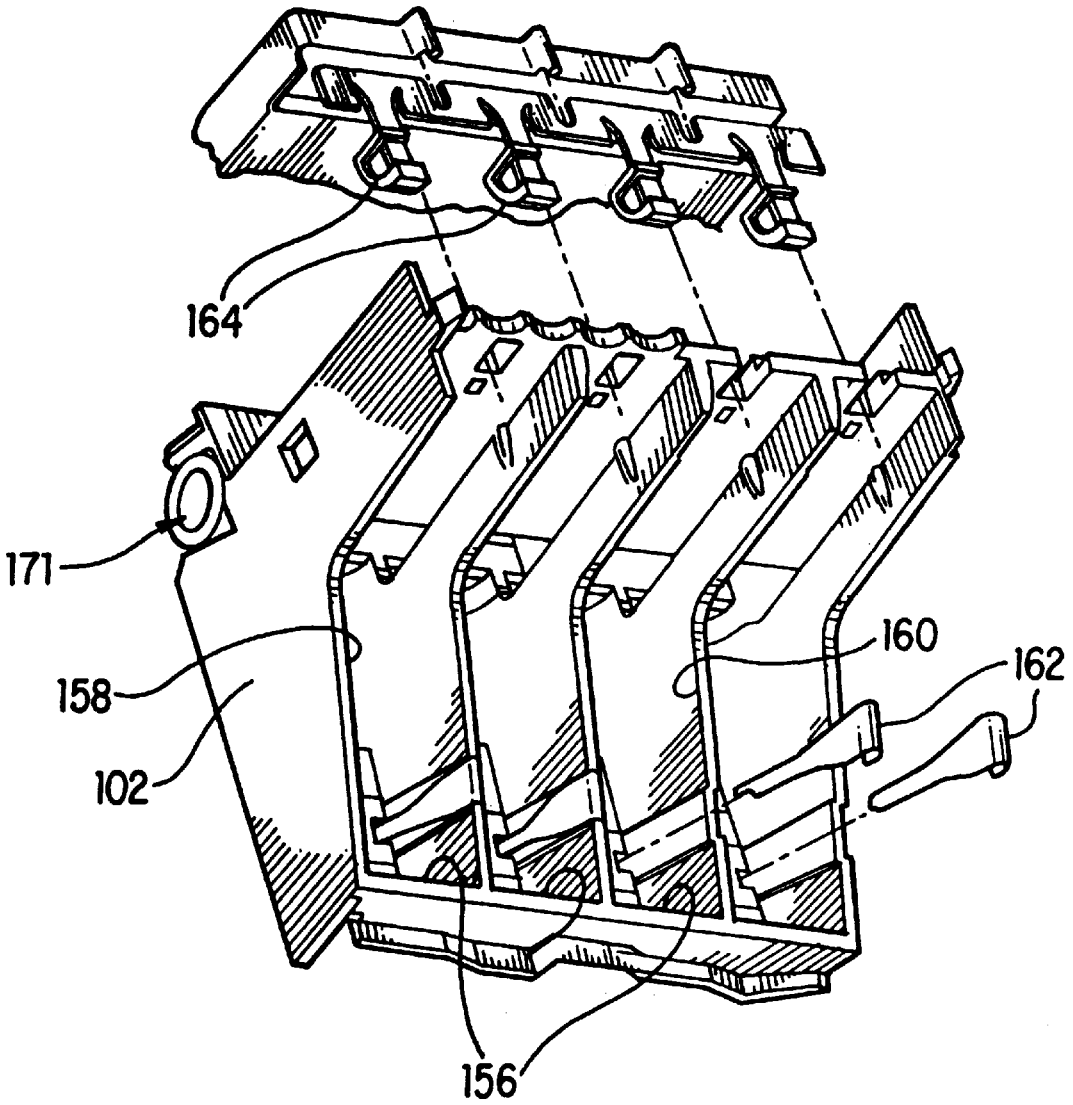
FIG. 5 shows the details of a four-slot carriage.
Figure 6:
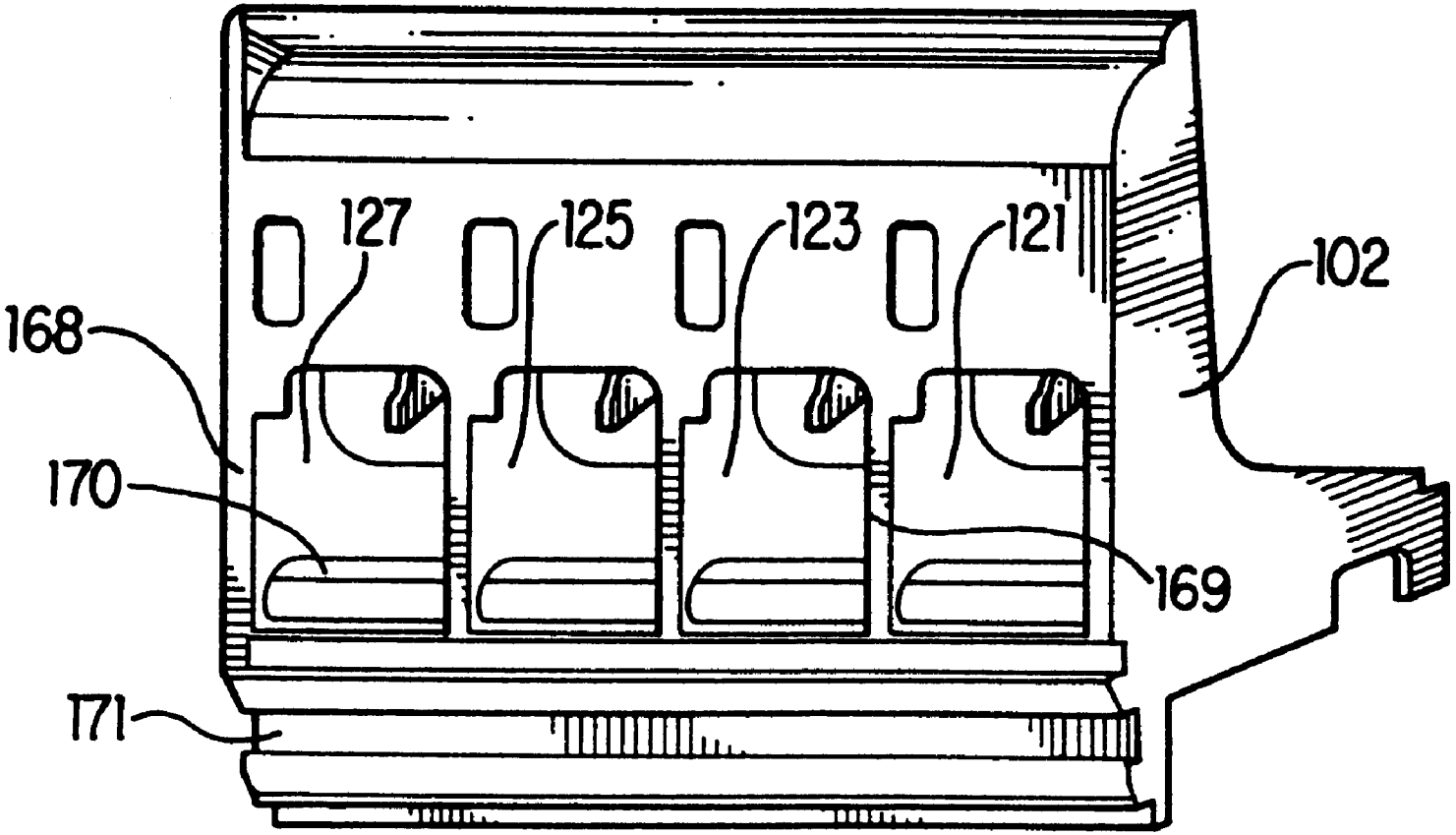
FIG. 6 is a bottom view of the carriage of FIG. 5.

Referring more specifically to FIGS. 1–3, the printer includes a control/display panel 140, service station casing 142, media release lever 144, ink primer collection unit 146 and service station frame 148.

Referring to FIGS. 4A–4C, 5 and 6, the details of the removable mounting of the cover member 104 on the carriage 102 are shown. In that regard, the cover member includes front ribs 150, left ribs 152 and right ribs 154 for respective engagement with front, left and right inside surface walls 156, 158, 160 of the carriage slots. Also, the cover member includes an outer shell which completely covers the unused carriage slots, without interfering with the lateral and upper biasing springs 162, 164 which securely mount the print cartridges in the carriage. Secure but removable attachment is provided by outward flanges 166 at the end of both flexible arms 106, which rest against bottom edges 168, 169 of the carriage slots, without interfering with the electrical interconnect pads 170 or the slot 171 for slidably receiving a carriage support rod 172.

Although the invention has application for different types of service stations, the preferred embodiment includes a spittoon 180 at one end of the printer and a multipurpose service station 182 at the other end of the printer. The preferred version of the multipurpose service station includes a priming function which is achieved by a vacuum generating unit having a bellows device with a return spring 8 and an operating push-button 9 which is disposed vertically. The pushbutton is acted on by a return spring 10 and has a projecting stub 11 which is intended to bear on an intermediate rocker arm 12 which has an arm 13 and bears on a thrust element 14 incorporated in the end of the bellows 7. The rocker arm 12 is pivotable about a transverse axis 77 in the body 15 supporting the vacuum unit and also has a resilient abutment 16 which, in combination with a fixed abutment 17 of the supporter 18, actuates the devices for gripping the various pipes.

Figure 7:
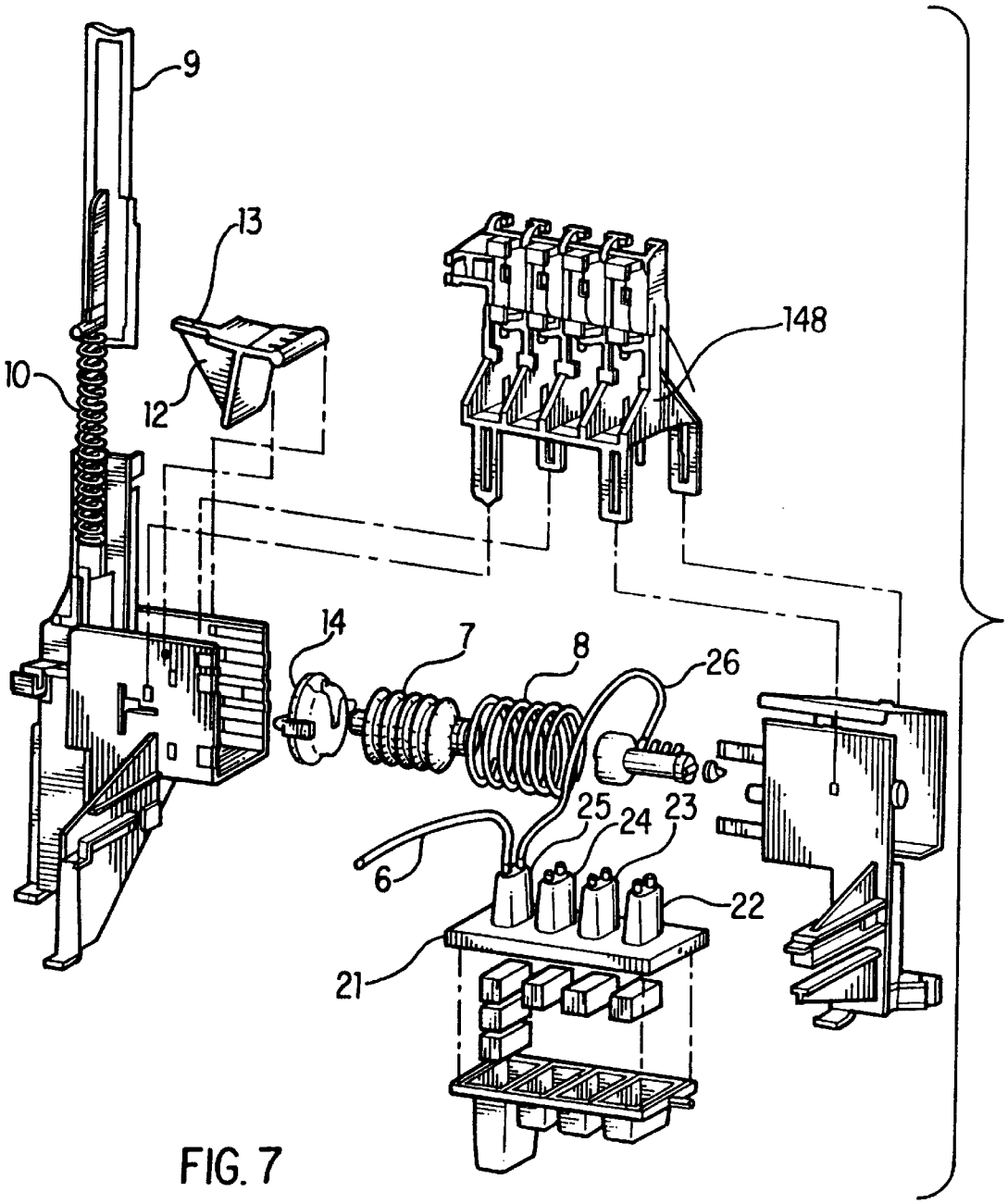
FIG. 7 is an exploded view of the primer portion of the wiper/primer service station.

The actual embodiment of the flexible pipes, one of which is indicated by the numeral 6 in FIG. 7, includes an intermediate distributor body 21 provided with a number of individual chambers 22, 23, 24, 25 corresponding to the number of nozzle arrays to be serviced at the service station. Each individual chamber receives a pipe such as 6 for eventual connection to the nozzle array to be primed, and a further flexible pipe for communication with the outlet distributor 19 of the vacuum unit. One of these pipes is indicated by numeral 26, a characteristic of the pipes being that they are normally closed by being gripped, for which reason the vacuum suction produced by the expansion of the bellows 7 brought about by the spring 8 is effective only in the pipe which is in the open condition owing to the cancelling of the gripping action.

Figure 8:
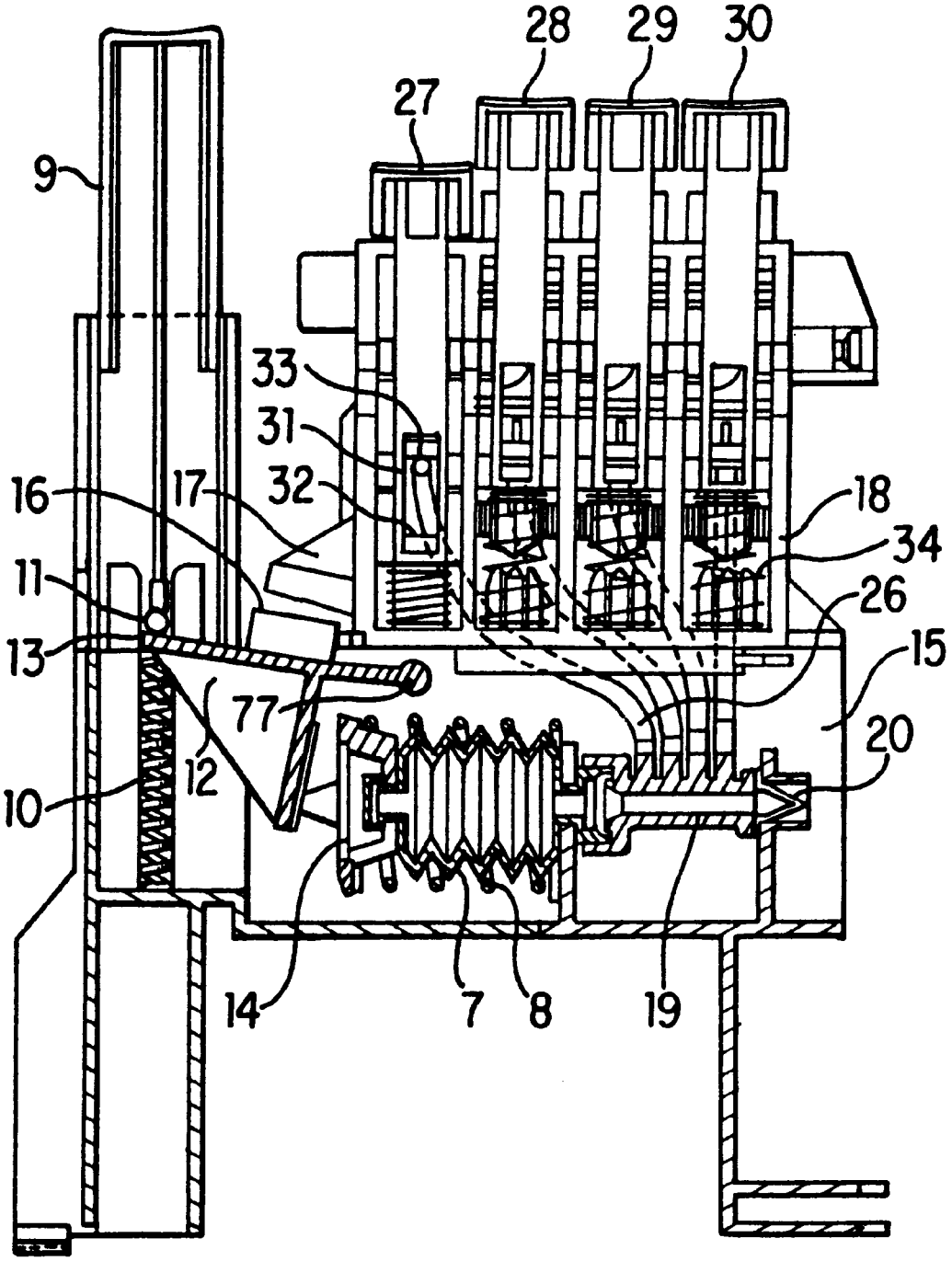
FIG. 8 is a back sectional view of the primer portion of the wiper/primer service station with one of the user-activation buttons in a depressed active position.
Figure 9:
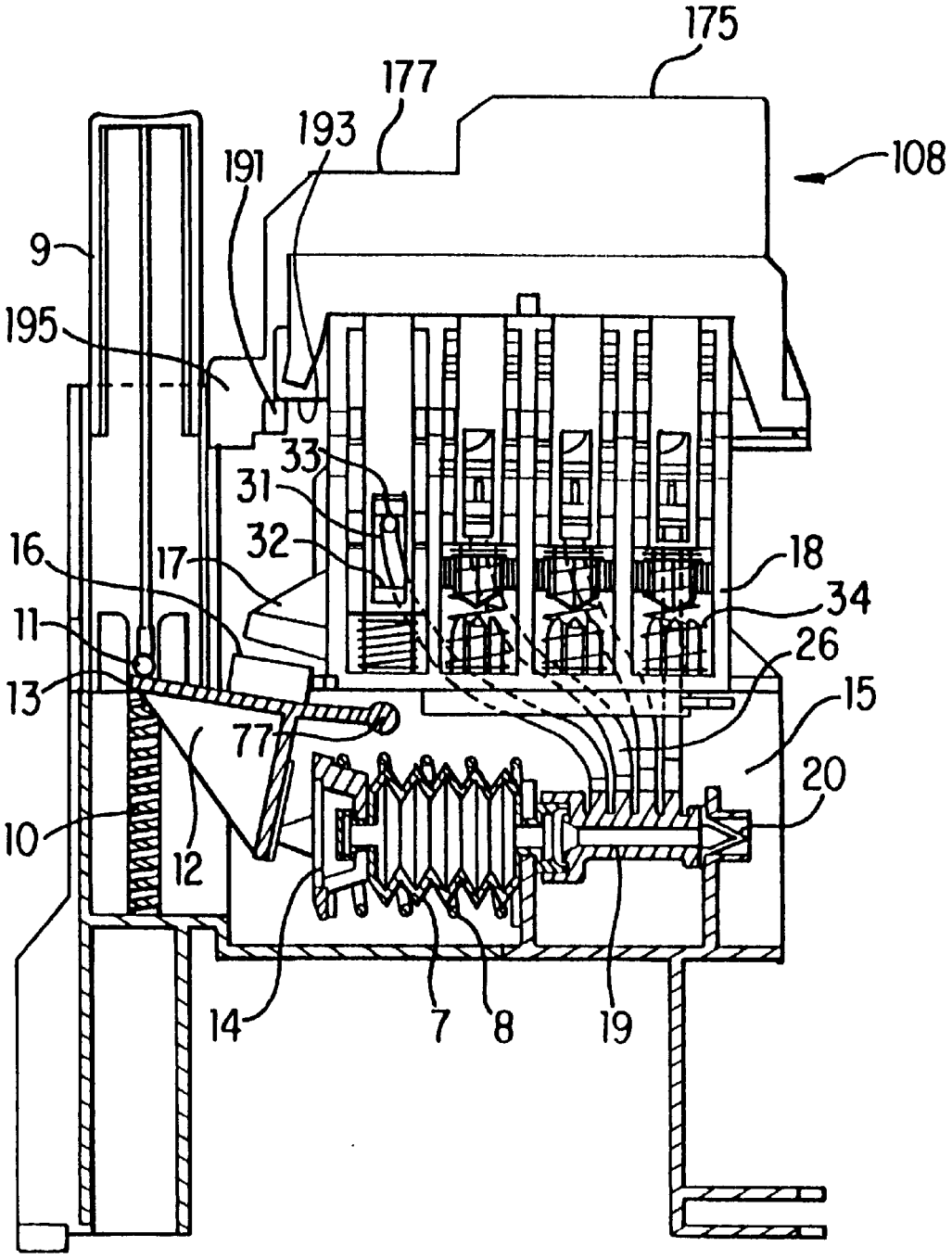
FIG. 9 is the same back sectional view of FIG. 8 showing a service station cover installed over the user-activation buttons.
Figure 10:
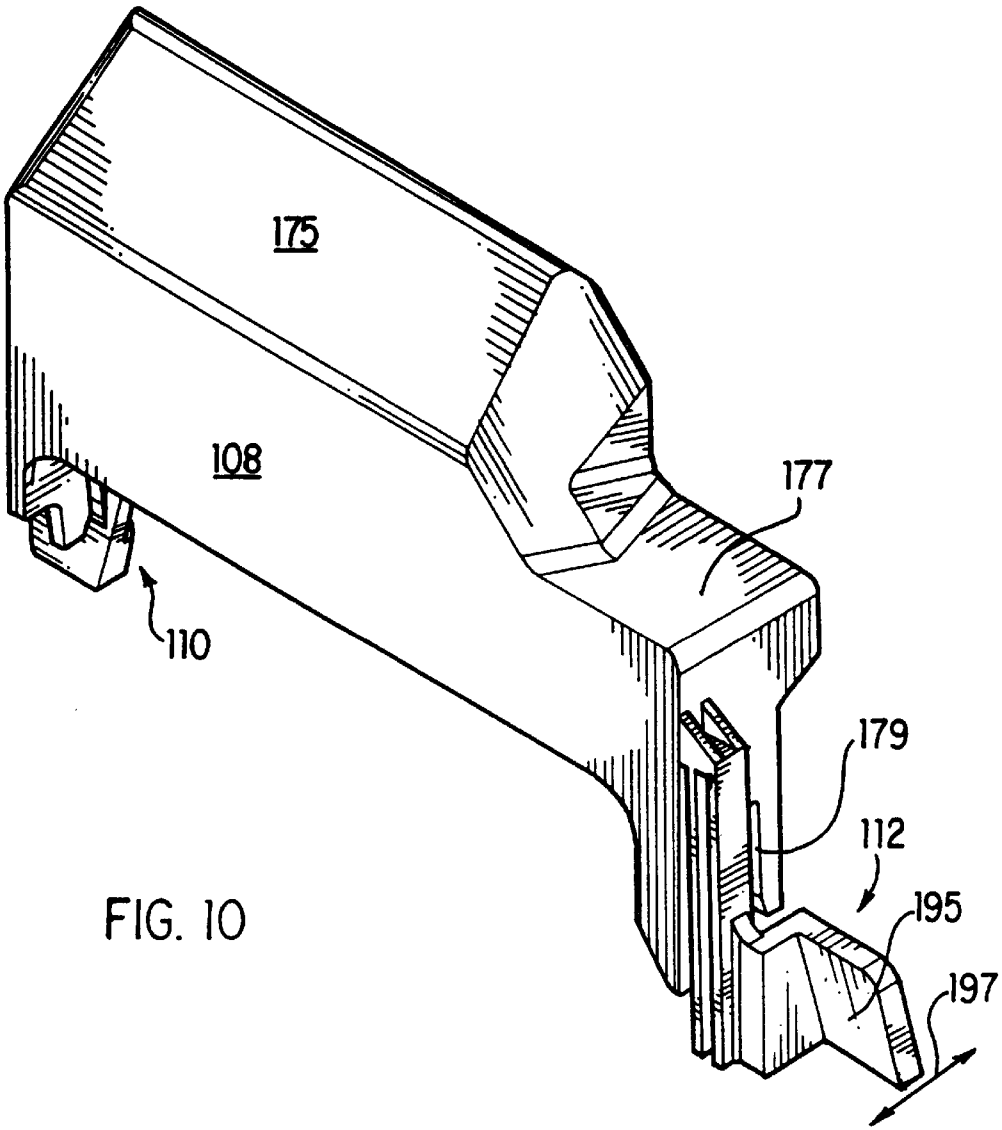
FIG. 10 is a top front perspective view of the service station cover.
Figure 11:
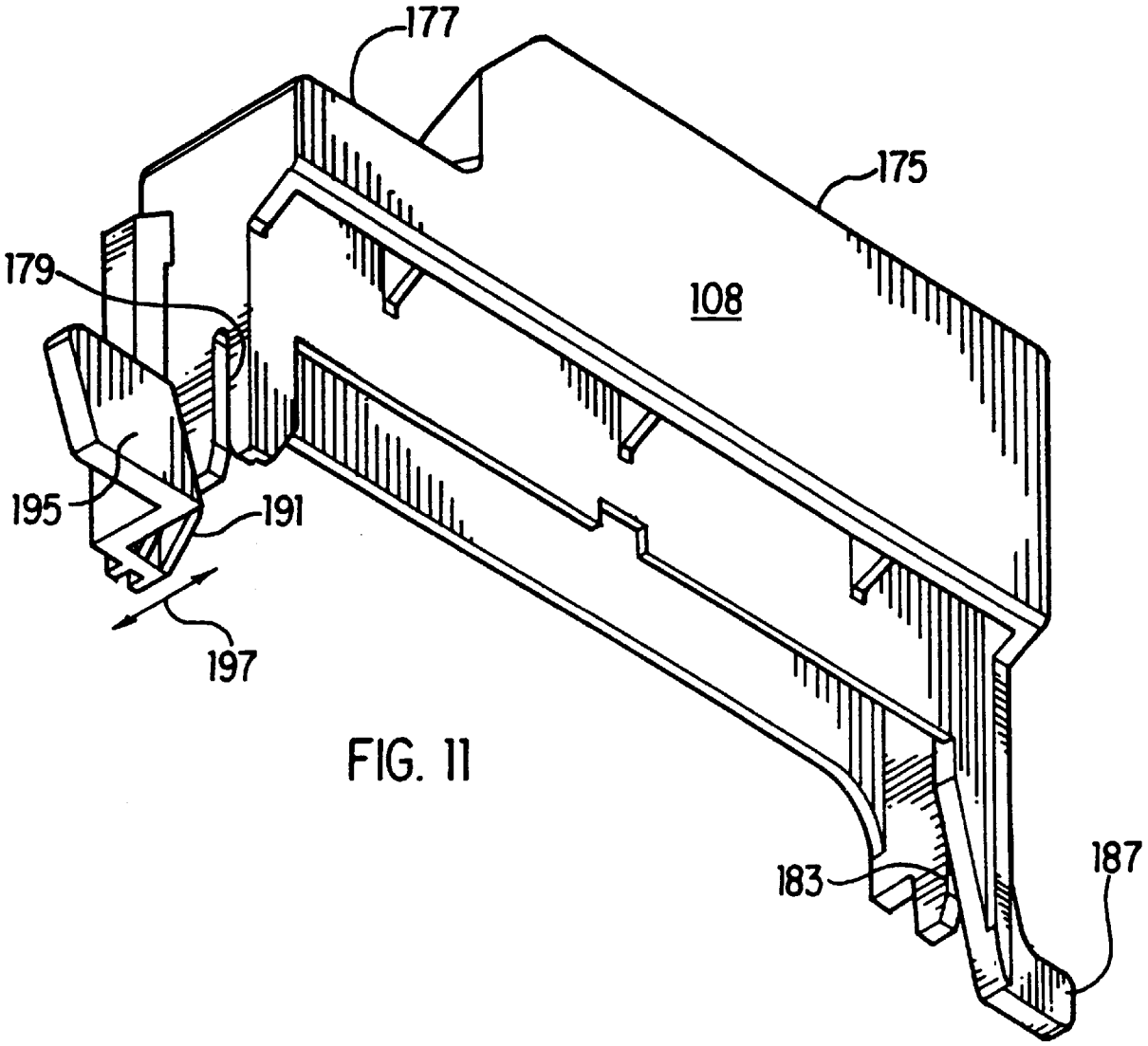
FIG. 11 is a bottom rear perspective view of the service station cover.
Figure 13:
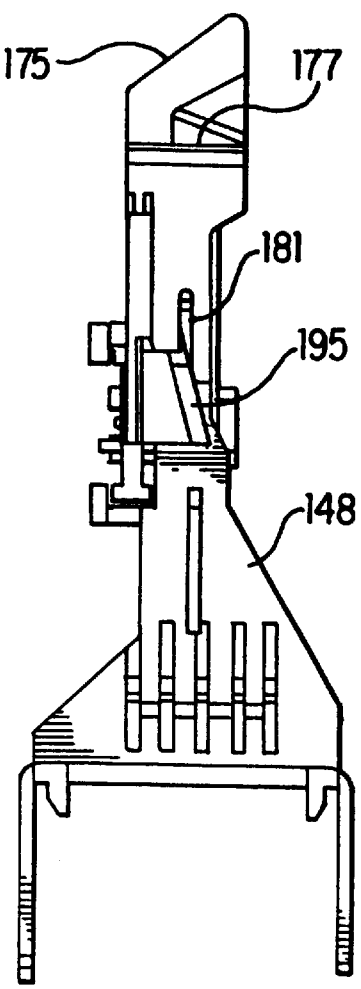
FIG. 13 is a right end view showing the service station cover installed over the user-activation buttons.
Figure 12:
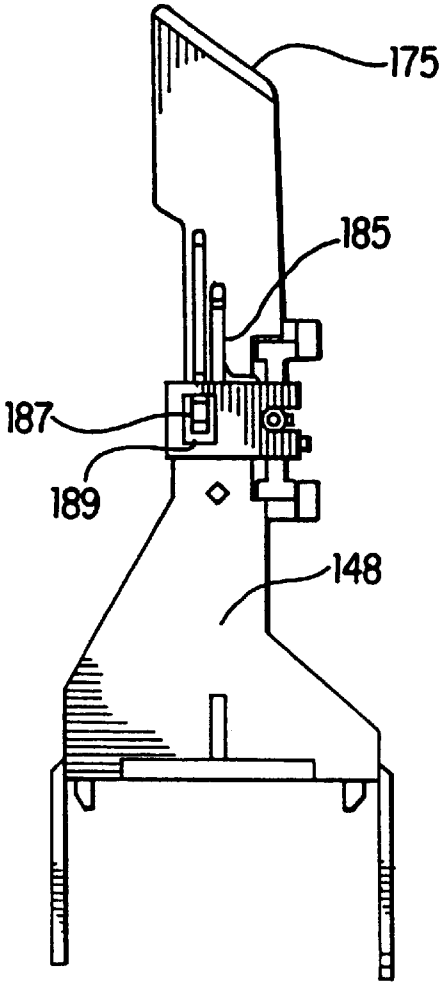
FIG. 12 is a left end view showing the service station cover installed over the user-activation buttons.

For the closure by gripping and the optional release of the various pipes 26 corresponding to each chamber of the body 21, and finally to each array of injection nozzles, a key system is used for gripping the various pipes. As shown in FIGS. 8–9, various key or buttons 27, 28, 29, 30 include bodies having large lower windows such as the window 31 for the key 27, a lower edge 32 of which will grip the corresponding pipe which extends through the window 31, trapping it against the upper edge 33 of the fixed body carrying the actuation buttons. Lower return springs such as spring 34 for the button 30 acts on each key and restores the position of the button once it is released.

In normal position, all of the pipes for communication with the nozzle arrays will be closed. At the moment when it is desired to carry out a cycle for priming one or more of the nozzle arrays, a corresponding button is pressed, releasing the grip and thus opening the corresponding flexible pipe. The complete function of such a service station is implemented in the Hewlett-Packard DesignJet Series CAD printers.

The details and function of the control member 108 are shown in FIGS. 9–12. In that regard, the control member is shown as a primer cover which includes a raised portion 175 for completely covering the three actuation buttons 28, 29, 30 which are prevented from being depressed when the printer is operating in monochrome mode, and a lowered portion 177 which holds the fourth actuation button 27 in constant depressed position so that priming can always take place with the black print cartridge 120 when the printer is operating in monochrome mode. Stability and positioning of the control member 108 on the service station frame is facilitated by a right slot 179 on the control member engaging a first elongated protrusion 181 on the frame, and a second slot 183 on the control member engaging a second elongated protrusion 185 on the frame. Finally, a short projection 187 at the bottom of fixed tab 110 fits into a matching slot 189, and a clip 191 at the bottom of flexible tab 112 engages a bottom edge 193 of the frame, with handle 195 having a large surface for manual movement of the clip into or away from an installed position in the directions of arrow 197.

FIGS. 14 A–E and 15 A–E are self-explanatory for showing the steps for actually making the conversion from a single cartridge monochrome printer to a multiple cartridge color printer.

Figure 14A:
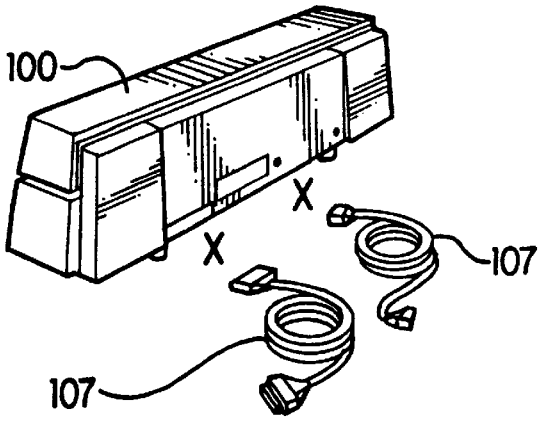
FIGS. 14A through 14E show the sequence of steps for changing the software configuration from a monochrome to a color printer.
Figure 14B:
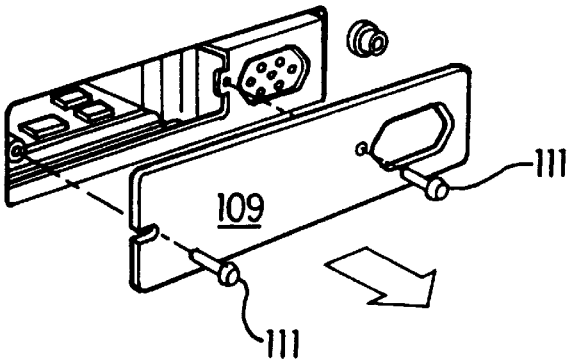

Initially the user must be sure that the plotter is switched off and that neither the power cord 105 nor any interface cable 107 is connected (FIG. 14A). The cover plate 109 is removed by detaching the screws 111 (FIG. 14B).

There are two slots for SIMMs in the plotter. The new ROM SIMM 114 containing the upgrade goes in the second slot furthest from the user, behind the first slot which is used for conventional flash ROM in the form of SIMM memory modules. If the first slot nearest to the user already contains a SIMM memory module 113, then the user must first remove the SIMM memory module, in order to have access to the second slot.

Figure 14C:
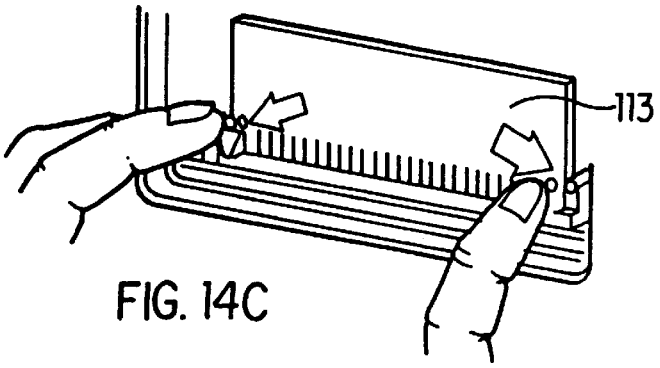
Figure 14D:
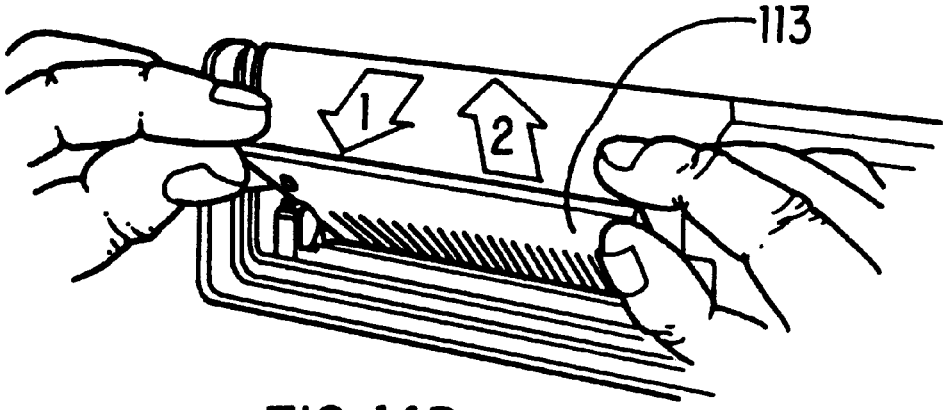
Figure 14E:
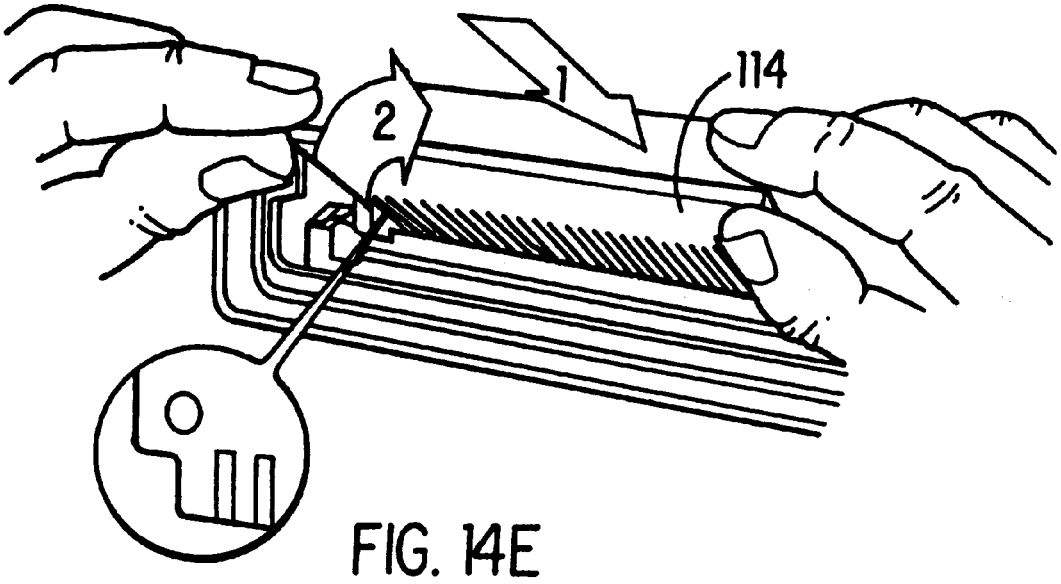

The steps for removal of the SIMM memory module 113 are shown in FIGS. 14C–14D. The user can gently push aside the two clips that hold the SIMM memory module in place. By holding it only by the edges, and carefully pulling the top of the module toward the user, the SIMM memory module can be lifted out of its slot and removed from the plotter. The removed SIMM memory module is temporarily placed on a conductive pad such as the same one containing the new color ROM SIMM module 114.

The new ROM SIMM module is taken out of its protective bag and held only by the edges. With its small notch on the left and the metallic edge away from the user, the new color ROM SIMM module is loaded into the slot furthest away from the user. To do this (see FIG. 14E),the new color SIMM module is held at an angle, the bottom edge is placed in the slot and then the top is pushed away from the user until the new module clicks into place. If a SIMM memory module was previously removed from the first slot nearest to the user, it is re-installed in its original slot in the same manner as just described for installing the new color ROM SIMM module. The cover plate is then replaced with its attachment screws.

Figure 15A:
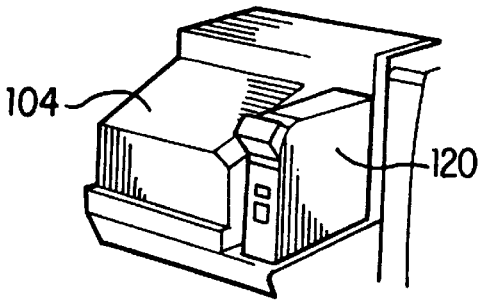
FIGS. 15A through 15E show the additional steps for removing the carriage cover and the service station cover, as well as replacing the carriage and control/display panel labels.
Figure 15B:
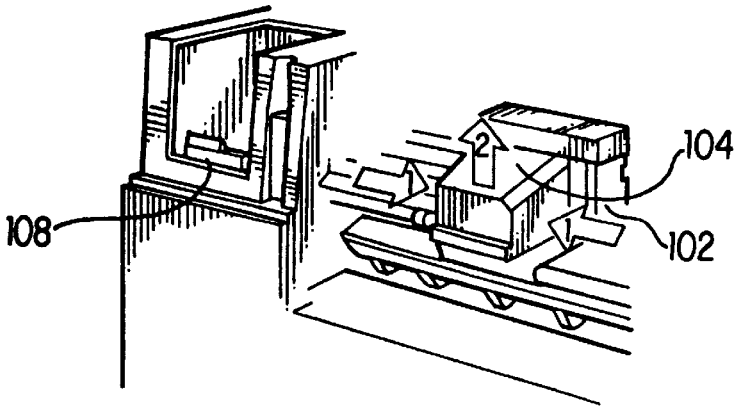

With the plotter still switched off, the plotter cover 115 is raised to provide access to the carriage 102 which is in the service station at the left end of the plotter, and the black ink cartridge 120 is then removed (FIG. 15A) from its right end carriage slot 121. The carriage is then moved to the right out of the service station to be easily accessable. The carriage cover 104 can then be manually removed from covering the three left-hand carriage slots 123, 125, 127 by first squeezing on both sides to bend the legs 106 toward each other to release the flanges 166, and then lifting it up for removal from the carriage (FIG. 15B).

Figure 15C:
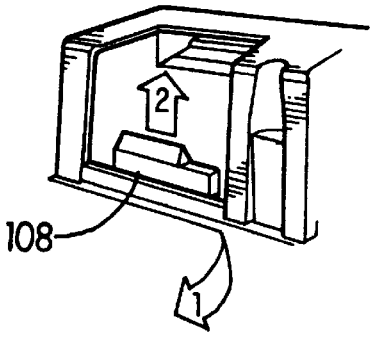

The user then manually removes the primer cover from the three left-hand primer selectors in the service station (see FIG. 15C) by first releasing the clip on the right side of the primer cover near the bottom and then lifting the cover up for removal from the service station.

Figure 15D:
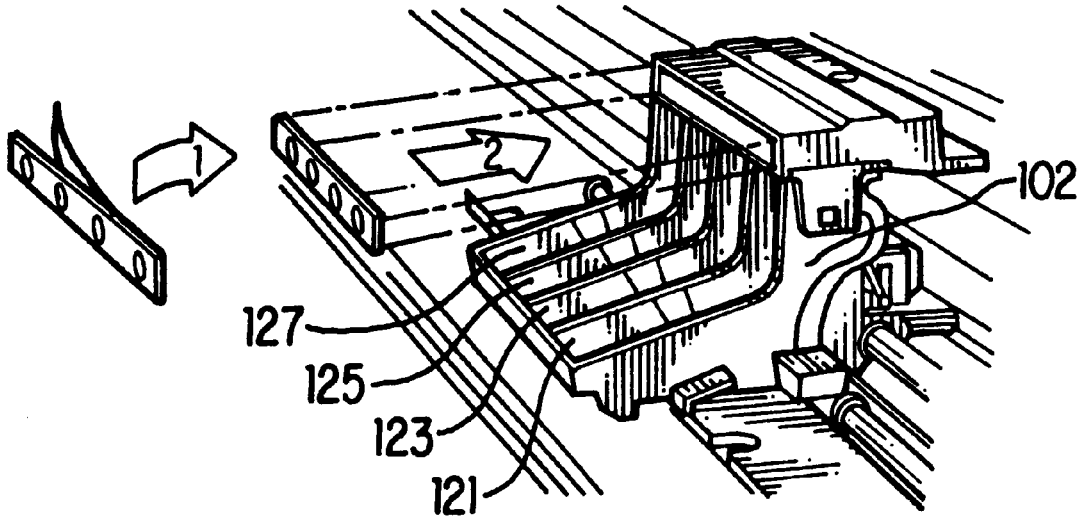
Figure 16:
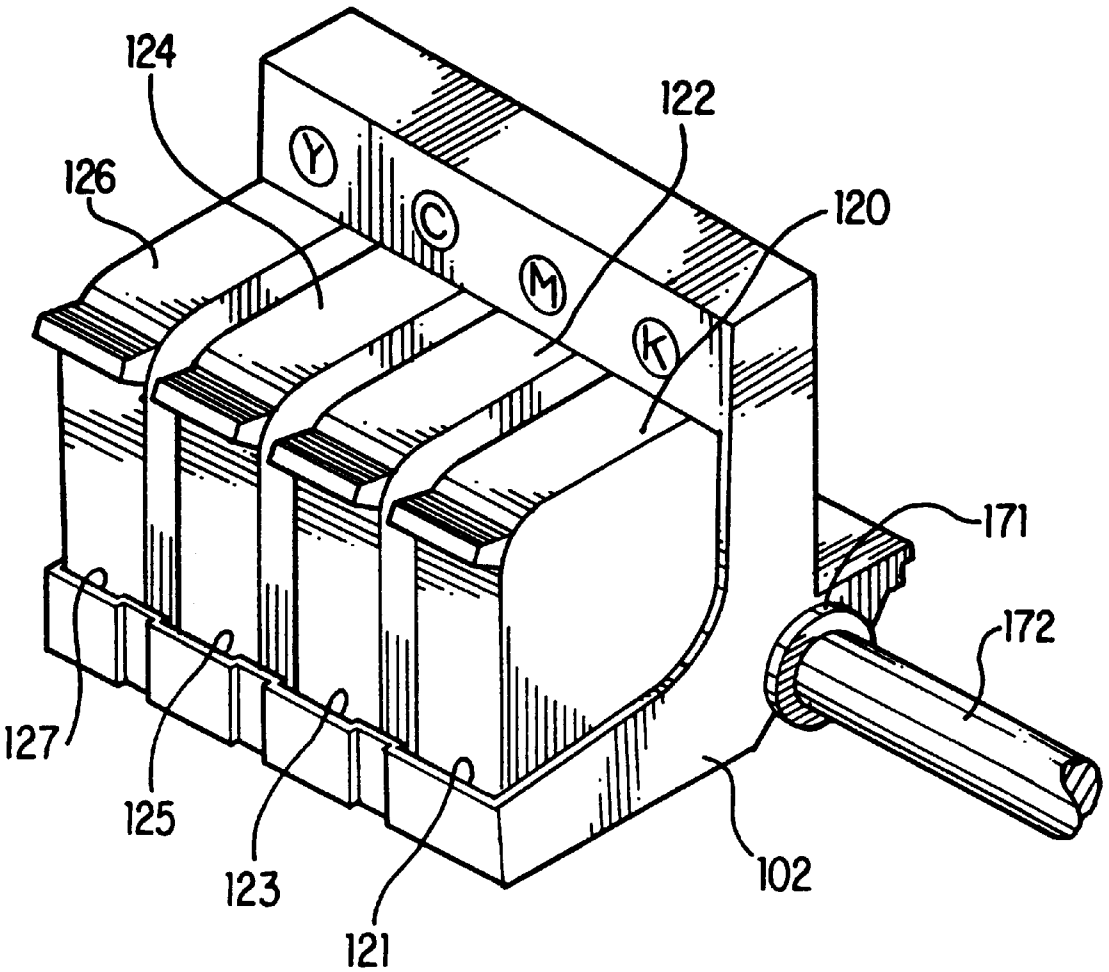
FIG. 16 shows the carriage with four different color ink cartridges installed after the conversion.

From the upgrade kit, the user takes the new label containing four colored dots. A protective strip is removed from the back of the label, and the label is placed with its sticky backside against the vertical panel above the cartridge stalls so that the yellow dot is on the left, with a color dot being located above each slot to indicate the location of each different color ink cartridge (see FIGS. 15D and 16). After inserting the new color ink cartridges, the plotter cover 115 is then closed.

Figure 15E:
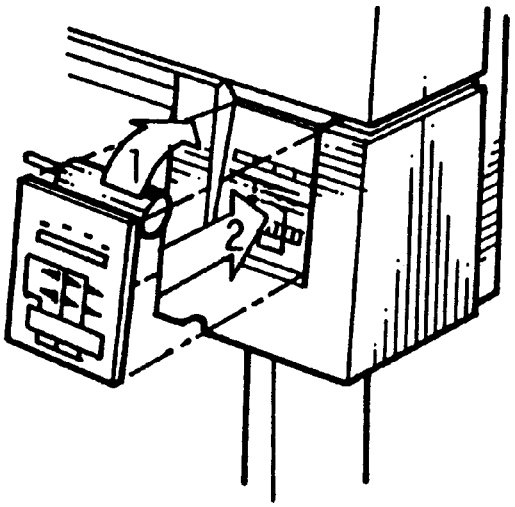

From the upgrade kit, the user takes the new overlay label for the front control/display panel. A protective strip is removed from the pack of the label, and the label is placed directly over the old front panel (FIG. 15E). A new label is needed because in the preferred embodiment the printing of certain media is performed differently when printing full color printing (all four print cartridges) as compared to printing on the same media in monochrome.

The plotter is now switched on.

From the upgrade kit, the user takes the three new color ink cartridges (yellow, cyan and magenta) and together with the black cartridge removed earlier, installs them in the four vacant cartridge stalls in the carriage (see FIG. 16), being sure to match the colors of the cartridges with the colors of the dots on the carriage label.

A Setup Sheet is printed to confirm that the plotter has correctly read the new ROM SIMM and has reconfigured itself to be a color plotter. Finally, the print drivers are reconfigured to indicate that the device is no longer a monochrome model plotter, but instead a color model plotter. Color printer drivers for various software applications are typically supplied as part of the upgrade kit.

In the preferred embodiment, all of the operational software is programmed so that it is possible to have the same "normal code" in both the monochrome version and color manufactured versions of the printer. When a monochrome version operates with a black print cartridge using the "normal code", the firmware looks for the contents of the original "model configuration" flag which is set during manufacturing in the EEROM (electrically erasable read only memory) to determine whether the printer unit is a color or monochrome device. However, the mask ROM has the capability of conditionally bypassing this original "model configuration" flag. The condition that must exist is the installation of a correct ROM SIMM in the printer. Thus, the mask ROM is continually sensing whether a correct SIMM ROM is in the memory slot (i.e., a newer release for this particular printer model), and if so, the new ROM SIMM code written for operating a full color plotter is always executed. This means that so long as the new ROM SIMM is installed, during initial "power on" as well as during normal operation of the printer, the original "model configuration" flag is ignored. However, if the ROM SIMM is ever removed, the printer reverts to operation as a regular monochrome printer.

Additionally, upgrades for the color printer can be incorporated as part of the ROM SIMM so that a user converting to color can also enjoy the benefits of the latest de-bugged and/or revised code for the color printing function.

It is to be understood that while a preferred illustrative embodiment of the invention has been shown and described, various changes will become evident to those skilled in the art without departing from the spirit and scope of the invention as defined by the following claims.

We claim as our invention:

1. An inkjet printer for printing in a monochrome mode of operation or alternatively in a color mode of operation, and having a scanning carriage which traverses between a print zone and a service station, comprising:

a plurality of slots on the carriage having a size and a shape for holding a predetermined number of print cartridges which are respectively installed in said slots;

a plurality of actuation members in the service station for respectively servicing each of said predetermined number of print cartridges while the print cartridges remain installed in the carriage; and a removable barrier is manually mounted on the carriage to a position of engagement in the monochrome mode for preventing the installation of at least one of said print cartridges in at least one of said slots on the carriage and is manually removed to a position of disengagement in the color mode for allowing the installation of said at least one of said print cartridges.

2. The inkjet printer of claim 1 wherein said removable barrier includes a unitary member which in the monochrome mode is attached to the carriage in a latched position directly engaging the carriage.

3. The inkjet printer of claim 2 wherein said unitary member at least partially covers said plurality of slots on the carriage in the monochrome mode.

4. The inkjet printer of claim 2 wherein said unitary member includes an arm being moved between the latched position directly engaging the carriage and an un-latched position allowing said unitary member to be either manually mounted in the monochrome mode or manually removed from the carriage in the color mode.

5. The inkjet printer of claim 1 wherein said plurality of slots includes at least four slots on the carriage for holding black ink and color ink cartridges.

6. The inkjet printer of claim 5 wherein said plurality of slots includes one end slot for holding a black ink cartridge.

7. The inkjet printer of claim 1 which further includes a control member on the service station which is positioned in a first location so as to prevent operation of one of said actuation members associated with said one of said print cartridges in said at least one of said slots when said barrier is mounted on the carriage in the monochrome mode.

8. The inkjet printer of claim 7 wherein said control member is positioned in a second location so as to allow operation of said actuation members associated with said print cartridges which are installed in said slots on the carriage.

9. An inkjet printer for printing in a monochrome mode of operation or alternatively in a color mode of operation and having a carriage which traverses between a print zone and a service station, comprising a plurality of slots on the carriage adapted for holding a predetermined number of print cartridges which are respectively installed in said slots;

a plurality of actuation members in the service station for respectively servicing each of said predetermined number of print cartridges while the print cartridges remain installed in the carriage; and a control member on the service station which is positioned in a first location so as to prevent operation of said actuation members which are associated with print cartridges which are not installed in said plurality of slots on the carriage.

10. The inkjet printer of claim 9 wherein said service station includes a functioning component taken from the group of priming, wiping, and capping; and wherein said control member is manually removed from the service station in the color mode without any need for modifying said functioning component of the service station.

11. The inkjet printer of claim 10 wherein said control member is manually installed on the service station in the monochrome mode without any need for modifying said functioning component of the service station.

12. The inkjet printer of claim 9 wherein said control member includes stop means positioned in a first location so as to prevent operation of an actuation member associated with at least one of said print cartridges which is not installed in at least one of said slots on the carriage during monochrome mode.

13. The inkjet printer of claim 9 wherein said control member is positioned in a second location for assuring operation of said actuation members associated with said print cartridges which are installed in said slots on the carriage during color mode.

14. An upgrade kit technique for converting an inkjet printer from a monochrome mode of operation into a multiple cartridge color mode of operation comprising a procedure of providing a carriage in the printer with multiple slots for receiving a plurality of print cartridges including one slot adapted to receive a black print cartridge and additional different slots adapted to receive one or more color print cartridges;

manually inserting a ROM device with new color printing configuration code into a memory module slot in the inkjet printer;

installing the black print cartridge and the one or more color print cartridges into their respective slots;

executing the new color printing configuration code to change an internal operation function of the printer from actuating the black print cartridge only in monochrome mode as well as to actuate the one or more newly installed color print cartridges in color mode with each of the color print cartridges respectively installed in a carriage slot which did not originally hold a black print cartridge.

15. The upgrade kit technique of claim 14 which further includes installing a plurality of color print cartridges into their respective slots.

16. The upgrade kit technique of claim 15 which further includes installing a plurality of at least three separate cartridges having cyan, magenta and yellow ink, respectively.

17. The upgrade kit technique of claim 14 which includes incorporating the ROM device in a SIMM, and installing the SIMM in the printer prior to powering on the printer in order for the printer to function as an upgraded color printer.

18. The upgrade kit technique of claim 14 which includes incorporating the ROM device in a SIMM, and maintaining the SIMM in the printer during a printing operation in order for the print to function as an upgraded color printer.

* * * * *